US006120022A

United States Patent [19]

Stokes

[11] Patent Number: 6,120,022

[45] Date of Patent: Sep. 19, 2000

[54] RANDOM NUMBER SELECTOR FOR OVERHEAD PROJECTORS

[75] Inventor: William T. Stokes, Sunnyvale, Calif.

[73] Assignee: Stokes Publishing Company, Sunnyvale, Calif.

[21] Appl. No.: 09/178,376

[22] Filed: Oct. 23, 1998

[51] Int. Cl.[7] ..... A63B 71/00

[52] U.S. Cl. ..... 273/141 R; 273/142 HA

[58] Field of Search ..... 273/141 R, 142 HA, 273/142 R, 142 A, 142 B, 142 C, 142 D, 142 H, 142 J, 142 JA, 142 JB, 142 JC, 142 JD, 142 K

[56] References Cited

U.S. PATENT DOCUMENTS

| | | | |
|---|---|---|---|
| 1,619,849 | 3/1927 | Brittingham | 273/141 R |
| 3,214,848 | 11/1965 | Van Eycke | 35/35 |
| 3,399,893 | 9/1968 | Payne, Jr. | 273/94 |
| 3,545,758 | 12/1970 | Payne, Jr. | 273/94 |
| 3,762,716 | 10/1973 | Horton | 273/161 |
| 4,243,223 | 1/1981 | Ver Hoef et al. | 273/141 R |
| 4,508,344 | 4/1985 | Krogh | 273/141 R |
| 5,118,110 | 6/1992 | Jones | 273/141 R |
| 5,232,222 | 8/1993 | Deutch | 273/142 HA |
| 5,332,227 | 7/1994 | Passero | 273/243 |
| 5,779,851 | 7/1998 | Ifkovits et al. | 156/505 |

OTHER PUBLICATIONS

Creative Publications (Probability Section)—Overhead Spinners and Templates Set.

ETA—Catelog pp. 109, 143—Spinners for the Overhead, Overhead Spinners.

Creative Publications Catalog Page, Overhead Spinner & Templates Set.

ETA Catalog pp. 109, 143, Spinners for the Overhead, Overhead Spinners.

*Primary Examiner*—Jeanette Chapman
*Assistant Examiner*—Dolores R. Collins
*Attorney, Agent, or Firm*—Thomas M. Freiburger

[57] ABSTRACT

A spinner for randomly selecting a number has a very low friction bearing between a transparent spinner member and a transparent base plate. In one embodiment the base and spinner are formed of a transparent plastic such as Plexiglas, with a cone point set screw mounted in a threaded hole of the base plate and providing a narrow point for seating of the spinner member. A transparency with annularly arranged numbers may be placed at the bottom side of the transparent base plate, and different numerical arrays or symbol arrays may be selected. The spinner member has a central hole fitted with a central hub that has a recess formed into an internal cone shaped apex. The cone angle of the set screw point is steeper than that in the apex of the hub recess, so that the spinner member rests essentially only on the narrow point of the set screw. When the number selector device is placed on an overhead projector, as in a classroom setting, a gentle turn of the spinner member will generate five or ten revolutions of the spinner arrow, which gradually comes to a stop in the random selection of a number or symbol.

2 Claims, 3 Drawing Sheets

RANDOM NUMBER SELECTOR FOR OVERHEAD PROJECTORS

BACKGROUND OF THE INVENTION

The invention is concerned with random selection devices, and in particular with such a device useful with an overhead projector to enable an audience or class to view the process of selecting a random number or other symbol.

"Spinners" for selecting a number or symbol to be used in the playing of a board game are well known. A typical spinner comprises a cardboard base with angular field divisions or domains divided by lines which are radii from a central spinning point, with each field division having a number, letter, game symbol, color, etc. In these devices a spinner arrow or needle, usually of thin metal, is mounted on the center of the base, usually with a type of rivet connection. A flick of the finger would activate the spinner.

In these spinners there typically was no attempt to provide perfect balance of the needle or to provide a bearing which could maintain the needle in a balanced position, so the needle would drag against the face of the cardboard base when spinning and would come to rest rather quickly, without any particular suspense or drama.

Compasses have used balanced needles in which a needle hub rested on a point for low-friction operation.

In the setting of a classroom or seminar, particularly in educating students using an overhead projector to demonstrate various principles, there is often a need to select a number, letter or symbol randomly. Although there are various ways to effect random number selection, including some designed for use on overhead projectors, none has been available wherein the selection can be demonstrated for the class on an overhead projector with low-friction spinner device that gradually stops at a random number with drama and suspense for the classroom.

SUMMARY OF THE INVENTION

The spinner device of this invention is well balanced and has a low friction bearing, and a gentle spin will generate a considerable number of revolutions before the spinner comes to a stop at a randomly selected domain or field division. The spinner device also is substantially transparent, allowing the spinner rotation to be seen by a class or a group as projected on a screen along with field numbers, letters or other symbols.

In a preferred embodiment the spinner member comprises a circular disk of transparent plastic material such as acrylic. An arrow, line or other pointing indicator is printed or otherwise fixed on the disk shaped spinner so as to clearly point to a number or other field division indicia when the disk stops. Preferably the arrow or pointer is opaque against the essential transparency of the spinner disk.

The spinner disk in a preferred embodiment has a central recess on its bottom side, placed accurately so that the recess is substantially at the center of gravity of the disk. This recess may comprise a bore directly in the bottom surface of the disk, or a special low friction hub, such as of brass, fitted into a hole in the center of the disk and itself having the recess. At the interior top of the recess is a pointed apex, preferably cone shaped, to receive a spinner support point extending up from a base member of the device.

The pointer is fixed in the base, which is transparent or primarily transparent. This support point can advantageously be formed of a threaded set screw having a cone point, the set screw being secured into a threaded hole of the base, which can be of a plastic similar to that of the spinner member. The cone point set screw has a cone angle sharper than that of the apex in the hub recess, so that when the spinner member is placed on the base, contact is made essentially only at the narrow point of the cone point set screw, providing for extremely low friction between the two components.

The hub and point can be reversed if desired; that is, a cone point can be fitted to protrude downwardly from the spinner member, to enter a hub recess of the base, open at its upper side.

For indicating domains or field divisions to be randomly selected by the spinner's pointer, the base can have a mostly transparent ring or generally annular arrangement of numbers, letters, or other symbols, fixed to or held against the front or back side of the base and projectable onto the screen by the overhead projector so as to be clearly visible. The array of symbols can be an annular ring of typical transparency material, laid on the top surface of the base and surrounding the spinner member. Symbol domains are angularly divided from each other by radial lines. Alternatively, and preferably, the symbols can be on a transparency sheet placed directly at the back side of the base, and this can be a solid transparency sheet which conforms to the size of the base, for ease in accurate placement of different and interchangeable symbol sheets against the base. Another option is to place the symbols in angularly divided field divisions on the disk shaped spinner itself, with a pointer arrow or line placed on the base for identifying the random selection. Thus, the field of symbols rotates and the indicator is fixed, as on a "wheel of fortune".

Accordingly, in one embodiment of the invention a spinner device for selecting random numbers or symbols and useful on an overhead projector comprises a transparent base adapted to rest on a stage of the projector, and an essentially transparent spinner member having a visible selection indicator or pointer and adapted to engage with the base in a low-friction connection. The connection is formed by a mounting point and a hub receiving the mounting point, one of the hub and point being fixed at the center of gravity of the spinner member and the other fixed to the base. The hub has a recess with an essentially cone-shaped apex, pointed and configured so that when the spinner member is placed down on the base with the mounting point in the hub recess, the mounting point extends into the apex of the hub recess and contacts the hub recess substantially only at the apex. The center of gravity location of this hub-and-point connection relative to the spinner member assures that the spinner member when rotating does not contact the base except at the point connection.

A transparent or primarily transparent field division device is placed against the base, with projectable indicia identifying a multiplicity of different field divisions to which the spinner can point. Thus, when the spinner member is rotated over the base, it spins with little friction, then comes to rest at a random position pointing to one of the field divisions.

It is therefore among the objects of the invention to improve over prior random symbol selecting spinners with a very low friction spinner device which increases the suspense and drama of random number or symbol selection. Another object is to provide such a low friction spinner device in a form essentially transparent and projectable using an overhead projector, so that the random selection process can be demonstrated for and viewed by a class or audience. These and other objects, advantages and features of the invention will be apparent from the following description of a preferred embodiment, considered along with the accompanying drawings.

DESCRIPTION OF PREFERRED EMBODIMENTS

Figure 1:
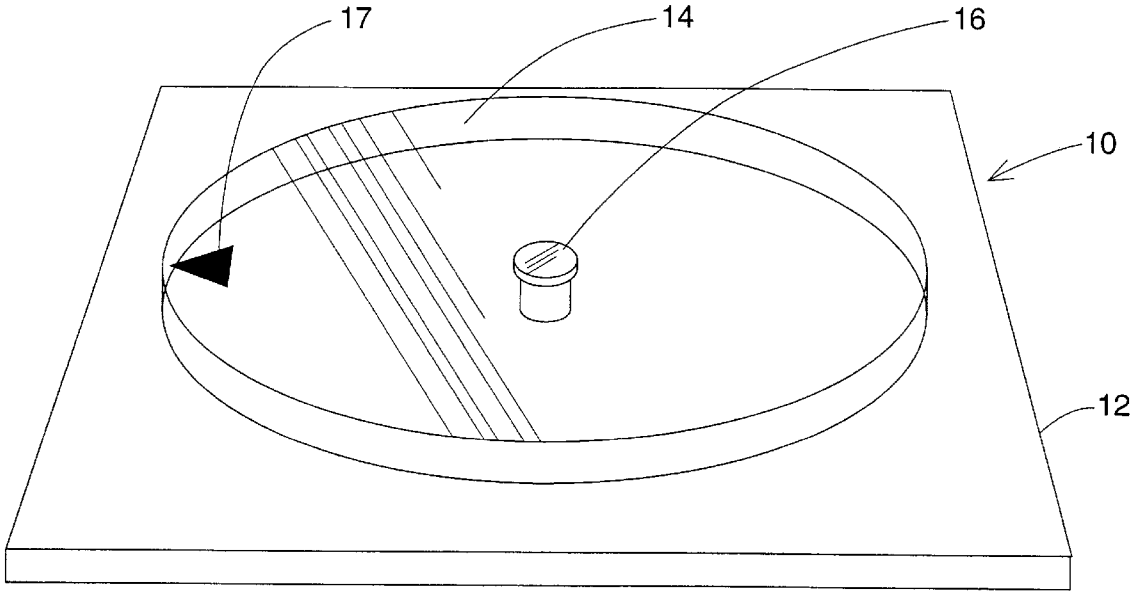
FIG. 1 is a perspective view showing an embodiment of a spinner device in accordance with the invention.

FIG. 1 shows a random selector device 10 according to a preferred embodiment of the invention. The selector device comprises a spinner which has a base 12 and spinner member 14. As indicated, the spinner member 14 is preferably a circular disk, but other configurations can be used. It is important that a hub 16 be located essentially precisely at the center of gravity of the spinner member, so that the spinner member can remain balanced on the base 12 and avoid contact between the spinner 14 and base 12 while the spinner is in motion. This balance is easily achieved with a circular disk, which if accurately formed and with the rotation point placed in the center, has equally distributed mass and radial length in all directions. Balance can also be achieved with an oblong or elongated spinner body, provided the rotational point is at the center of gravity, but such a spinner generally has more of a tendency to wobble and thus to experience high friction.

The base plate 12 and the spinner member 14 may be advantageously formed of a substantially clear plastic material such as acrylic. Other materials, such as other substantially clear and hard plastics, can also be used. It is important that the spinner device be transparent to the extent that the rotation of the spinner member 14, particularly its selection indicator or pointer arrow 17, can be clearly seen on the projected image when the device is used with an overhead projector.

Figure 2:
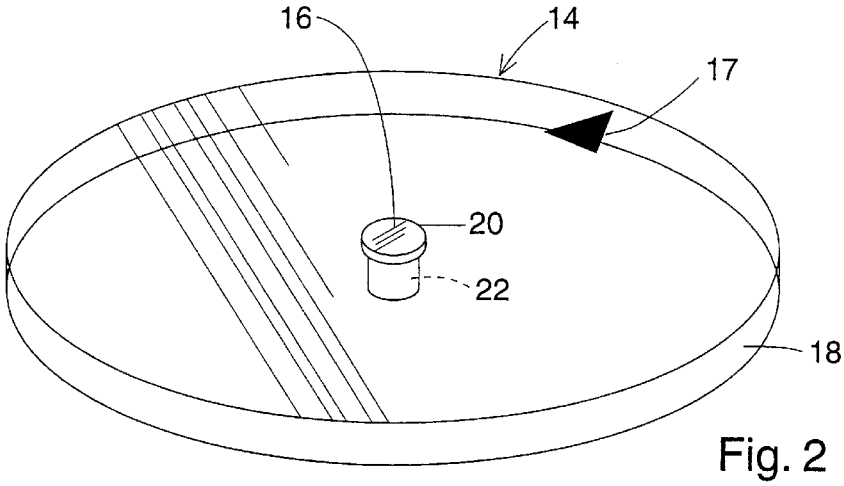
FIG. 2 is a perspective view showing a preferred form of spinner member for the spinner device.

FIG. 2 shows one preferred embodiment of the spinner member 14 in greater detail. The spinner 14 is shown with the arrow 17 printed onto the upper surface, near the peripheral edge 18. It could be applied by decal or tape. The hub 16 is seen with a flanged head 20 extending above the top surface of the spinner member. The remainder of the hub, i.e. a cylindrical portion 22 that extends downwardly and is fixed in the spinner member 14, is also visible. The hub 16 may be of brass or other metal, suitable for low friction operation. However, as noted above, the hub could be eliminated and replaced by a simple upward central bore from the bottom of the disk 14. When a hub with a recess is referred to herein, that term is intended to include such a simple bore in the spinner member (or in the base, as will be explained below).

Figure 4:
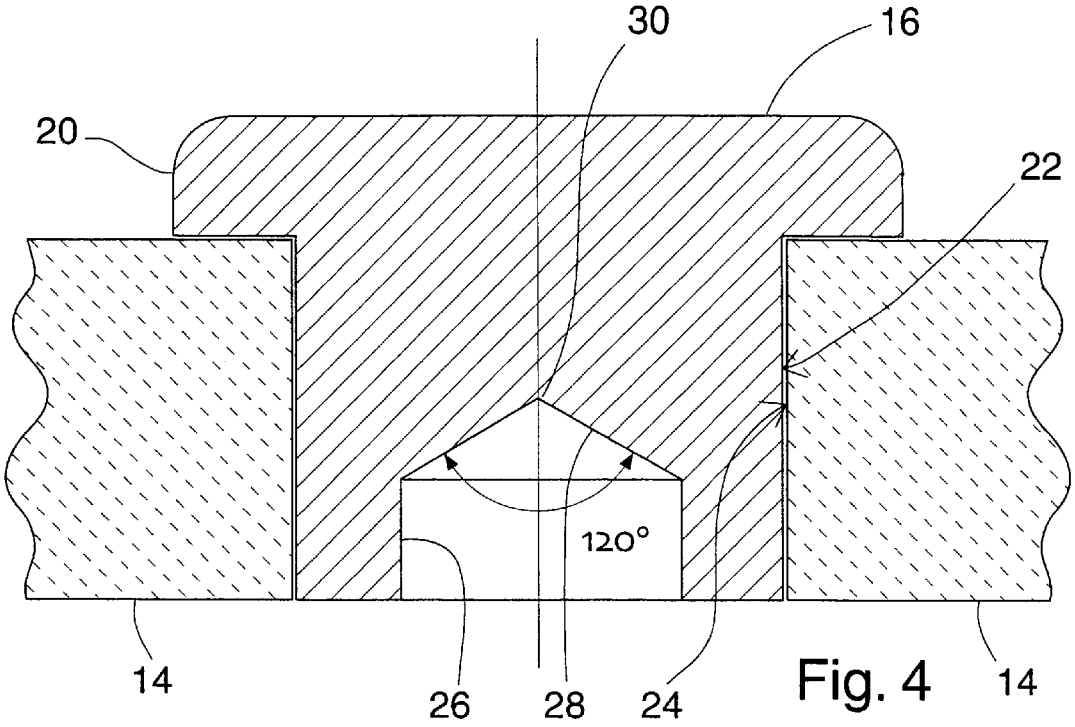
FIG. 4 is an enlarged detail view in elevational cross section, showing a central portion of the spinner member in accordance with one preferred embodiment.

FIG. 4 shows the hub 16 and its placement in the spinner disk 14 in greater detail. The metal hub is fixed in a hole 24 of the disk, the hole being accurately located at the center of the disk. The hub may be fixed in place with a suitable adhesive, or by a press fit, wherein either the hole or the cylindrical portion 22 of the hub is slightly tapered.

As FIG. 4 reveals, a recess or bore 26 is formed in the bottom of the hub. This recess has an apex cone 28 terminating in a pointed apex 30. The angle of the conical apex cone 28 may be about 120°.

Figure 3:
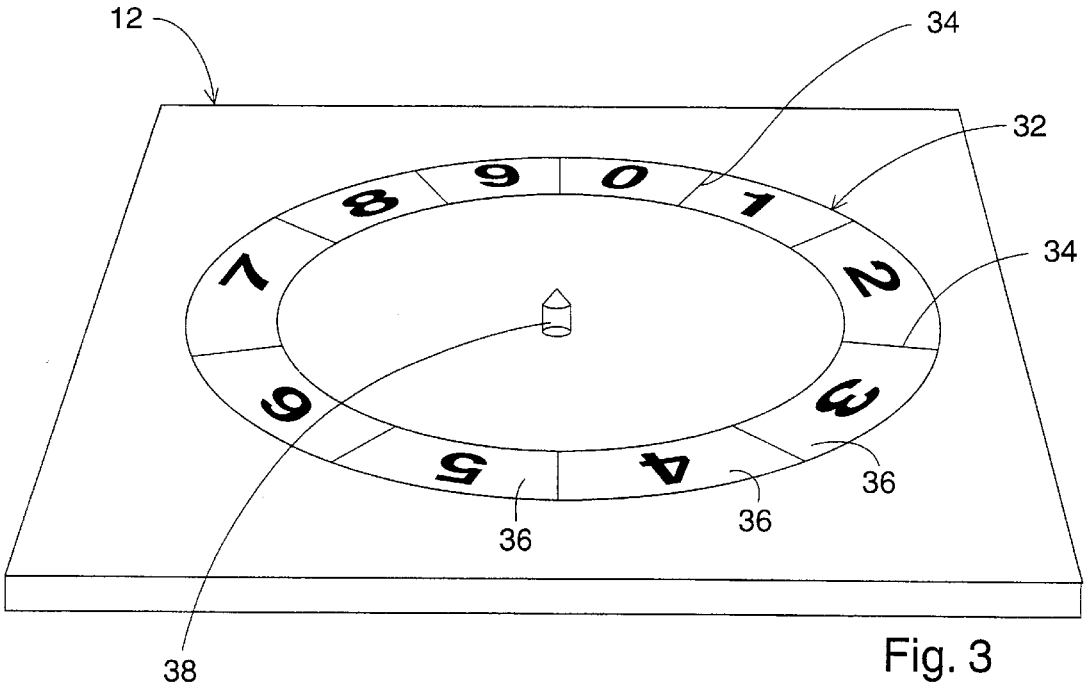
FIG. 3 is a perspective view showing a base member for the spinner device.
Figure 5:
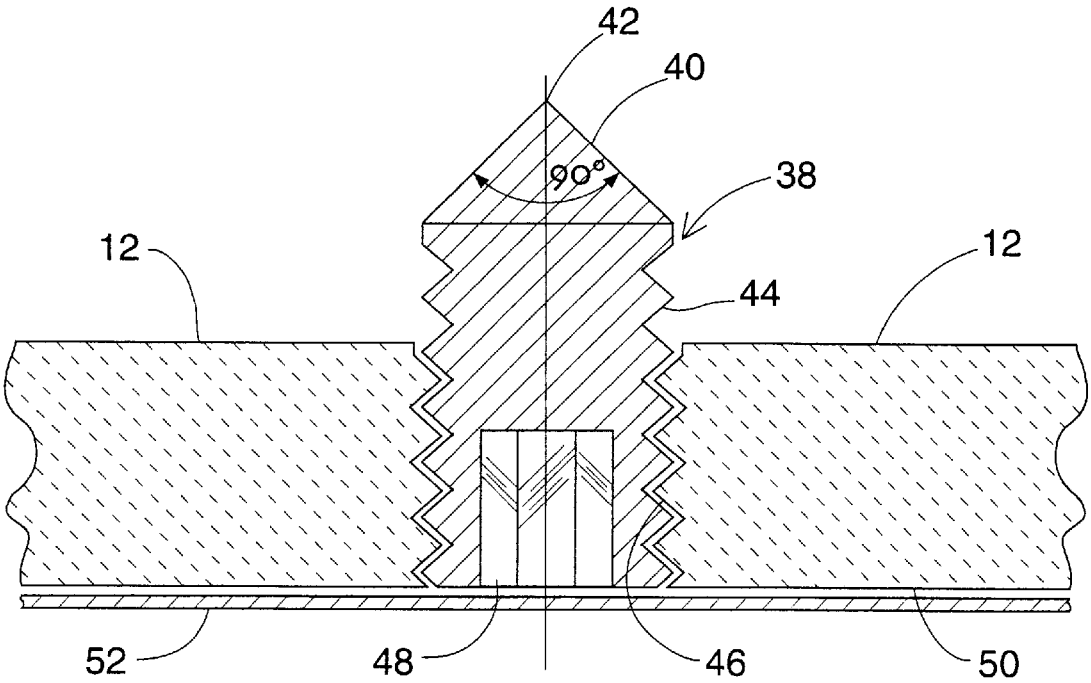
FIG. 5 is an enlarged detail view in section, showing the central portion of the base member of the spinner apparatus, revealing a support point to be engaged with a hub of the spinner member.

FIGS. 3 and 5 show exemplary embodiments of the base 12, which is shown square but could also be circular. FIG. 3 shows that an annular array or annulus or symbol ring 32 of numbers may be placed either on the top surface of the base or against the bottom of the base. This array of field division indicia is considered to be "on" a surface of the base 12, whether printed thereon by paint or decal, or whether (more preferably) printed on a transparency sheet that is placed against either the upper or lower surface. If placed on the top surface, the transparency should comprise an annulus 32 having an inside diameter larger than the diameter of the spinner disk 14, so as not to interfere with the free rotation of the spinner disk relative to the base. The ring 32 of numbers (or letters or other symbols) is divided by radius lines 34 angularly into a series of field divisions or domains 36. Virtually as many of these field divisions can be provided as desired, limited only by the resolution of the radial dividing lines 34 and the sharpness of the pointer 17 on the spinner disk. As noted above, the symbol ring 32 is substantially transparent, or the numbers or symbols can be transparent against an opaque or translucent field within the ring 32, so that these symbols or numbers are projected clearly by the overhead projector alongside the projection of the spinning disk, wherein at least the arrow or pointer 17 is visibly projected.

At the center of the symbol ring 32, fixed to the base 12, is a mounting point 38. This is shown in detail in FIG. 5, which shows that the mounting point 38 in a preferred embodiment is a cone point set screw, with a cone point 40 coming to a relatively sharp point 42. The angle of the cone 40 on the set screw is preferably less than the angle of the apex cone 28 in the recess 26 of the spinner hub, so that friction between the base and the spinner is extremely low, contact being essentially only between the set screw point 42 and the recess' pointed apex 30.

The cone point set screw preferably is secured by threads 44 into a threaded bore 46 in the base. After assembly, the set screw 38 may be fixed in place by an adhesive, such as the product LocTite. As indicated, the bottom of the set screw may have a hexagonal opening 48 for an allen wrench, for assembly. It is important that the set screw 38 be at least flush with the bottom surface 50 of the base plate, or recessed inwardly therefrom, so that the base plate can rest flatly on the stage of an overhead projector.

As noted above, the set screw (or another mounting point device) could be fixed centrally in the spinner disk or member 14, protruding downwardly; a receiving recess, such as in a hub 16 as shown above, is then formed in the base plate and open in the upward direction. In that case the hub would be a simple cylinder, without the flanged head 20 of the hub 16, so that the bottom of the base plate is flat. Again, such a recess to receive the support point device could be formed directly in the top surface of the base plate 12 if desired.

FIG. 5 also shows a transparency sheet 52, indicating the preferred placement of such a sheet, with field division indicia, under and against the bottom surface 50 of the spinner base 12.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A random selector device for use on an overhead projector, to enable selecting a number or symbol randomly while the process of selection is viewed by a group, comprising:

an essentially transparent base adapted to rest on a stage of an overhead projector, the base having a threaded through hole, a mounting point comprising a cone point set screw fitted in the threaded through hole with the narrow point of the set screw extending upwardly from an upper surface of the base plate, an essentially transparent spinner member having a central hub, the hub having a bottom recess with an essentially cone-shaped apex at its upper end, the apex being pointed and configured so that when the spinner member is placed down on the base with the hub recess over the mounting point, the mounting point extends into the apex of the hub recess and contacts the hub recess substantially only at said apex, and the hub being positioned substantially at the center of gravity of the spinner member such that the spinner member when rotating does not contact the base except in the hub recess, and the spinner member having a visible, projectable selection indicator, and projectable field division indicia on a surface of the base, identifying a multiplicity of different field divisions to which the spinner can point, whereby, when the spinner member is rotated over the base, the spinner member spins with little friction, then comes to rest at a random position pointing to one of the field divisions.

2. A random selector device for use on an overhead projector, to enable selecting a number or symbol randomly while the process of selection is viewed by a group, comprising:

an essentially transparent base adapted to rest on a stage of an overhead projector, the base having a mounting point extending upwardly from a top face of the base, an essentially transparent spinner member comprising an essentially circular disc of transparent plastic material and having a central hub, the hub having a bottom recess with an essentially cone-shaped apex at its upper end, the apex being pointed and configured so that when the spinner member is placed down on the base with the hub recess over the mounting point, the mounting point extends into the apex of the hub recess and contacts the hub recess substantially only at said apex, and the hub being positioned substantially at the center of gravity of the spinner member such that the spinner member when rotating does not contact the base except in the hub recess, and the spinner member having a visible, projectable selection indicator comprising a pointer on the surface of the transparent disc for indicating a field division, and projectable field division indicia on a surface of the base, identifying a multiplicity of different field divisions to which the spinner can point, whereby, when the spinner member is rotated over the base, the spinner member spins with little friction, then comes to rest at a random position pointing to one of the field divisions.

* * * * *